US005299961A

United States Patent [19]

Okamoto

[11] Patent Number: 5,299,961

[45] Date of Patent: Apr. 5, 1994

[54] VALVE ARRANGEMENT FOR AN EXHAUST PASSAGE IN A MARINE PROPULSION UNIT

[75] Inventor: Yutaka Okamoto, Shizuoka, Japan

[73] Assignee: Sanshin Kogyo Kabushiki Kaisha, Shizuoka, Japan

[21] Appl. No.: 962,672

[22] Filed: Oct. 19, 1992

[30] Foreign Application Priority Data

Oct. 19, 1991 [JP] Japan ..... 3-299705

[51] Int. Cl.[5] ..... B63H 21/32

[52] U.S. Cl. ..... 440/89

[58] Field of Search ..... 440/53, 88, 89; 181/235, 237; 60/324

[56] References Cited

U.S. PATENT DOCUMENTS

| | | | |
|---|---|---|---|
| 3,943,876 | 3/1976 | Kiekhaefer | 440/89 |
| 4,023,353 | 5/1977 | Hall | 440/89 |
| 4,545,771 | 10/1985 | Iio | 440/88 |
| 4,601,666 | 7/1986 | Wood | 440/89 |
| 4,897,061 | 1/1990 | Koepsel et al. | 440/89 |

OTHER PUBLICATIONS

1989 *Catalogue of VOVO PENTA*, Volvo Penta of America, Rockleigh, N.J. 07646-0927.

*Primary Examiner*—David M. Mitchell

*Assistant Examiner*—Stephen P. Avila

*Attorney, Agent, or Firm*—Bacon & Thomas

[57] ABSTRACT

A marine propulsion unit includes a cavitation cavity defining a supplemental exhaust gas passage terminating at an exhaust outlet port which is adapted to be opened and closed by a normally closed flapper valve member. The exhaust outlet port includes lateral sidewalls and the flapper valve member includes a fixed portion secured to one of the lateral sidewalls and a cantilevered portion that extends across the exhaust outlet port. The cantilevered portion is adapted to flex relative to the fixed portion so as to open and close the exhaust outlet port in response to dynamic forces acting on the valve member during operation of the watercraft. A stopper plate is provided to limit the deflection of the cantilevered portion of valve member. The cantilevered portion of the valve member is further provided with a fin which projects into the water during operation of the watercraft so that the dynamic pressure of the water acts against the fin the supplement the dynamic pressure exerted on the valve member by the exhaust gas pressure from within the supplemental exhaust passage and to cause the valve to open. When the watercraft is stopped, running at low speeds, decelerating or immediately after planning, the valve will assume a position in which it closes the supplemental exhaust outlet port to reduce exhaust noise.

5 Claims, 3 Drawing Sheets

VALVE ARRANGEMENT FOR AN EXHAUST PASSAGE IN A MARINE PROPULSION UNIT

BACKGROUND OF THE INVENTION

1. Field of the Invention

The present invention pertains to an exhaust assembly for use in marine outboard and inboard/outboard engines and, more particularly, to an exhaust valve arrangement for opening and closing an exhaust outlet of the exhaust assembly.

2. Discussion of the Prior Art

It is widely known in the art of marine propulsion units to form an exhaust passage inside a propeller hub. In these known arrangements, exhaust gases developed during operation of the marine propulsion unit were expelled into the water through an exhaust outlet of the exhaust passage. Since the exhaust outlet was submerge in water during operation of the watercraft, the noise generated during expulsion of the exhaust gases was minimized. However, due to the diameter of the propeller hub and the size of the casing which supports the propeller hub in such prior art arrangements, the size of the area of the exhaust outlet was limited. Limiting the area of the exhaust outlet caused exhaust back pressure to increase during periods of high engine load which resulted in a decrease in operation performance.

To overcome this problem, it has been proposed to provide an exhaust passage within a cavitation casing located above the propeller hub. By this construction, exhaust gases could be ejected rearwardly out of both the exhaust passage formed inside the propeller hub and the exhaust passage formed in the cavitation casing. Thus, the total area of the exhaust outlet was increased to effectively prevent the development of back pressure which resulted in improved engine performance. Unfortunately, the exhaust outlets provided in the cavitation casing always remained open such that under certain operating conditions, such as when the boat was planning, the exhaust outlet in the cavitation casing was located above the surface of the water which resulted in an exhaust noise problem.

The prior art has recognized this noise problem and has attempted to solve it by providing a valve to open and close the exhaust outlet. The exhaust valve according to the prior art is supported at the top of the exhaust opening and is suspended downward. With this valve arrangement, the lower edge of the valve can be engaged by various currents in the water and rotated to the open position such that the valve would substantially remain open when the boat had reached a certain speed. On the other hand, at speeds below a certain level, the exhaust valve would remain closed and thereby reduce exhaust noise. However, when the valve is opened by the outward pressure of the water currents acting on its lower edge, the lower edge of that valve is always in contact with the water surface. That same water surface also acts to close off the opening such that, during certain operating ranges of the boat, insufficient emission of the exhaust gases developed, resulting in a build up of exhaust gas back pressure and decrease of engine performance.

Therefore, there exists a need in the art for an exhaust passage arrangement for use in a marine propulsion unit which can function to allow appropriate free flow of exhaust gases so as to prevent exhaust gas back pressure throughout the entire range of operation of the marine propulsion unit.

SUMMARY OF THE INVENTION

It is an object of the present invention to provide an exhaust assembly for a marine propulsion unit which increases engine output when the marine propulsion unit is operating above certain speeds by assuring adequate exhaust gas expulsion.

It is another object of the present invention to provide an exhaust assembly for a marine propulsion unit which will lower exhaust noise when the propulsion unit is operated at speeds below a certain level.

These and other objects of the present invention are achieved by providing a marine propulsion unit having a cavitation casing formed with an exhaust passage which terminates in an exhaust outlet port defined by upper, lower and lateral side walls. The exhaust assembly further includes a valve member having a fixed portion secured to one of the lateral sidewalls of the exhaust outlet port and a cantilevered portion extending across the outlet port. The cantilevered portion is adapted to flex relative to the fixed portion so as to open and close the outlet port in dependence upon dynamic forces exerted on the valve member during operation of the watercraft. Since the valve member is secured to a lateral sidewall of the exhaust outlet port, when the valve member opens, the surface of the water will not block the opening of the exhaust outlet so as to assure emission of the exhaust gases and the prevention of exhaust gas back pressure.

Other objects, features and advantages of the present invention will become more readily apparent from the following detailed description of a preferred embodiment of the invention when taken in conjunction with the drawings wherein like reference numerals referred of corresponding parts in the several views.

DETAILED DESCRIPTION OF A PREFERRED EMBODIMENT

Figure 1:
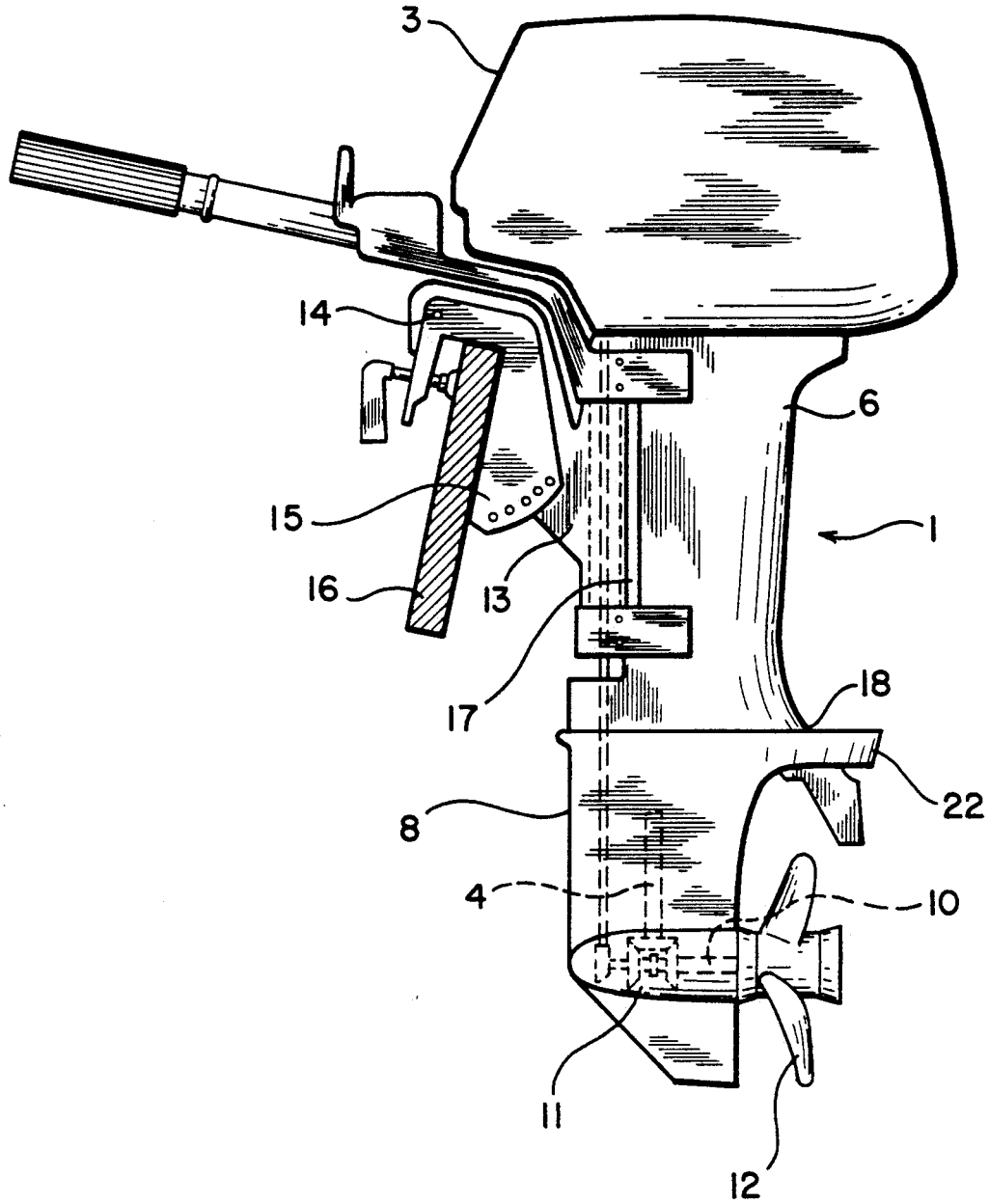
FIG. 1 is a side view of a marine outboard engine incorporating the exhaust assembly of the present invention.

A marine outboard propulsion unit incorporating the exhaust assembly of the present invention is generally indicated at 1 in FIG. 1. Propulsion unit 1 includes an engine 3 having an output shaft 4 which extends longitudinally from engine 3 through an upper casing 6 into a lower casing 8. Output shaft 4 is drivingly connected with a propeller shaft 10 within a gear box 11. Propeller shaft 10 is drivingly connected with a propeller 12. Propulsion unit 10 is mounted upon a swivel bracket 13 which can be tilted around a tilt shaft 14 with respect to a clamp bracket 15. Clamp bracket 15 removably secures propulsion unit 1 to a stern plate or transom 16 of a watercraft. Swivel bracket 13 is permitted to rotate left and right around a steering shaft 17 in order to steer the watercraft. Since the general construction of a marine outboard propulsion unit as described above is widely known in the art, further details thereof are not required herein.

Figure 2:
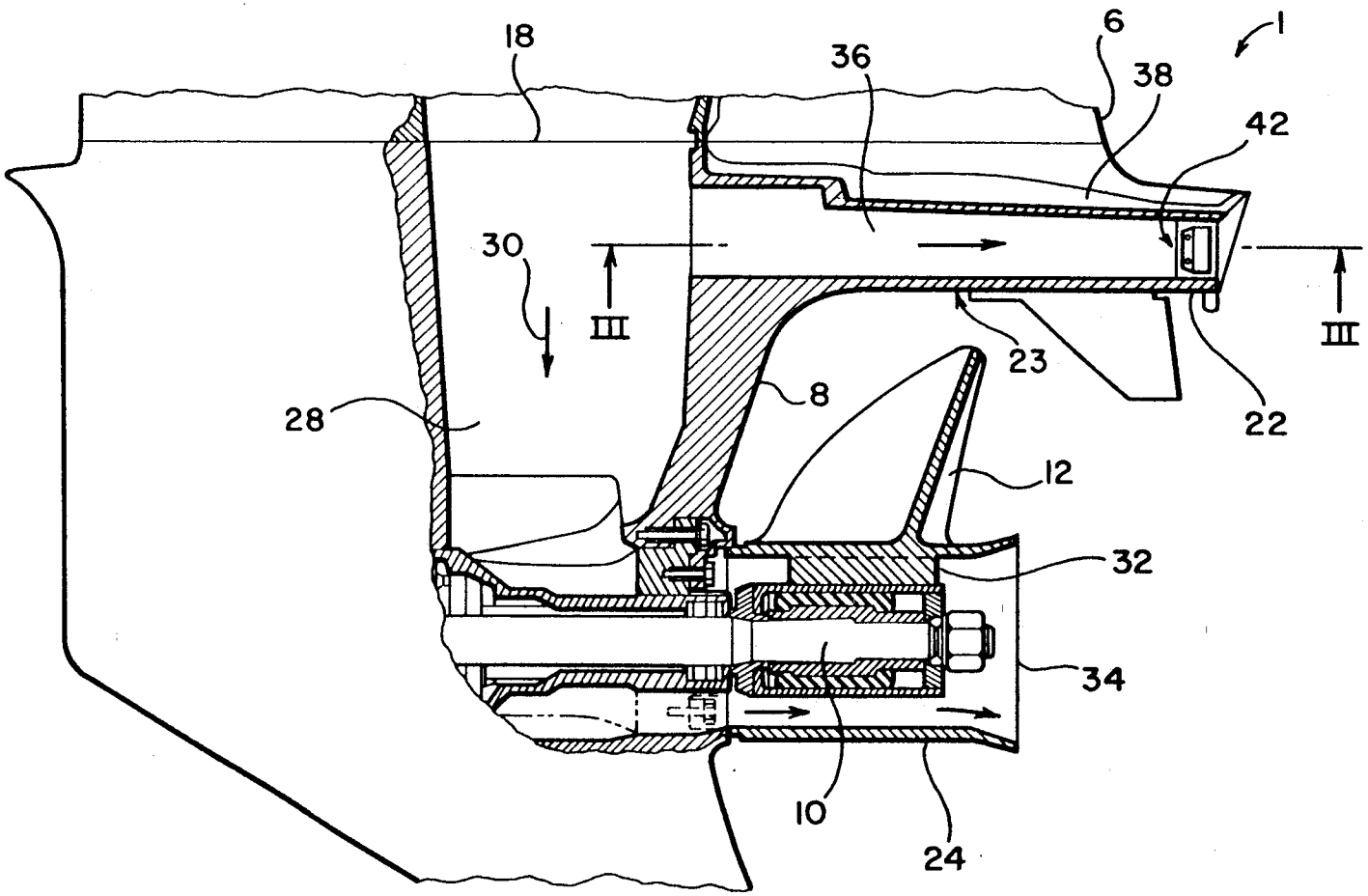
FIG. 2 is a partial cross-sectional view of a lower portion of the outboard engine shown in FIG. 1.

As best shown in FIG. 2, upper casing 6 is secured to lower casing 8 along a junction surface 18. Positioned slightly below junction surface 18 and formed as part of lower casing 8 is a cavitation plate 22 which forms a lower surface of a cavitation casing 23. Cavitation plate 22 is positioned above propeller 12 and extends rearward beyond the rearmost portion of propeller 12 as clearly shown in FIG. 2. A main exhaust passage 28 extends from engine 3 through upper casing 6 and lower casing 8 such that exhaust gases can flow downward in the direction of arrow 30. The exhaust gases that pass below cavitation plate 22 through main exhaust passage 28 flow around output shaft 4 of engine 3 and toward a hub 24 of propeller 12. Inside propeller hub 24, the exhaust gases are deflected by ribs 32 such that the exhaust gases are expelled into the water through an exhaust outlet 34 formed at the rear end of propeller hub 24.

Exhaust gases flowing through main exhaust passage 28 are also permitted to flow through a second exhaust passage 36 defined within cavitation casing 23 and which is in open fluid communication with main exhaust passage 28. An upper portion (not labeled) of cavity casing 23 also forms a portion of a cooling flow passage 38 located above second exhaust passage 36. Cooling passage 38 directs a supply of water used to cool engine 3 to a location where it is expelled from propulsion unit 1. Since cooling passage 38 does not form part of the present invention, no further description thereof will be provided.

Figure 3:
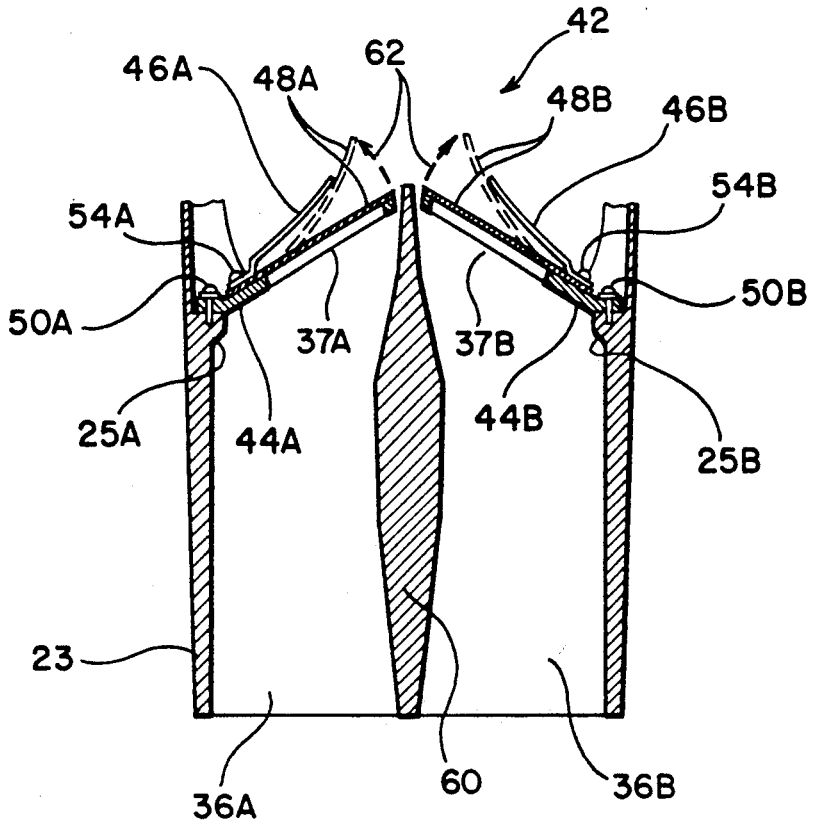
FIG. 3 is a partial cross-sectional view taken along line III—III of FIG. 2.

As indicated in FIG. 2 and best shown in FIG. 3, an exhaust gas valve device 42 according to the present invention is provided at the end of exhaust passage 36. According to the preferred embodiment of the invention, exhaust passage 36 is divided into two separate passages 36A and 36B. As exhaust valve device 42 includes symmetrical valving arrangements for outlet ports 37A and 37B located at the rear ends of exhaust passages 36A and 36B, respectively, the construction of only one of these valve arrangements will be described in detail and it is to be understood that the other valve arrangement is similarly constructed.

Figure 4:
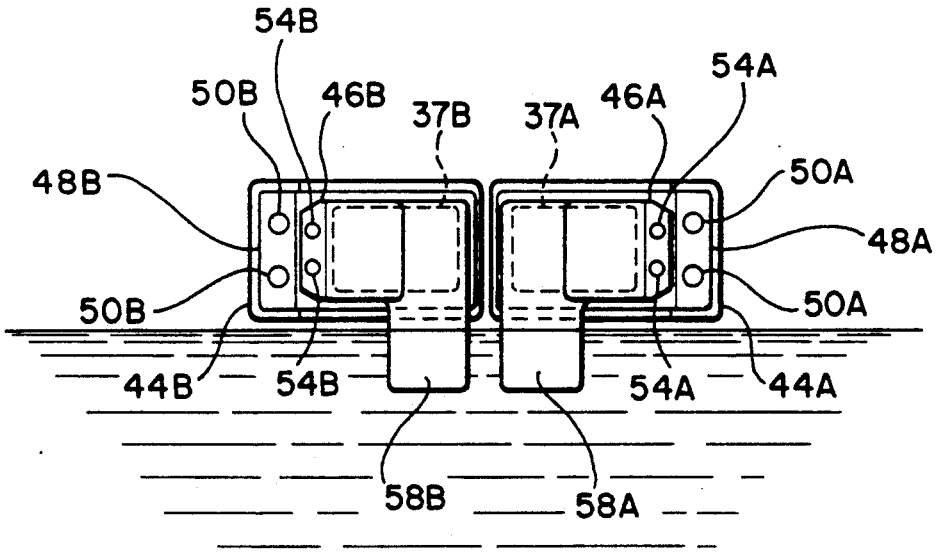
FIG. 4 is a rear end view of the exhaust assembly according to the present invention.

One of the valve arrangements of exhaust valve device 42 will now be described in detail with specific reference to FIGS. 3 and 4. Exhaust valve device 42 comprises a support plate 44A, a stopper plate 46A and a reed valve 48A. Support plate 44A is fixedly secured to a flange 25A of cavitation cavity 23 by upper and lower bolts 50A. Stopper plate 46A and reed valve 48A are also secured to support plate 44A. More specifically, a pair of bolts 54A are used to secure a first end (not labeled) of stopper plate 46A to support plate 44A along with a fixed portion (not labeled) of reed valve 48A with reed valve 48A being positioned between stopper plate 46A and support plate 44A as clearly shown in FIG. 3.

As previously stated, exhaust outlet port 37A permits the expulsion of exhaust gases passing through second exhaust passage 36. Reed valve 48A is adapted to open and close exhaust outlet port 37A in dependence upon dynamic forces exerted on reed valve 48A during operation of the watercraft. The dynamic forces referred to will be more fully discussed below. Reed valve 48A includes a cantilevered portion (not labeled) which is adapted to extend across and either open or close exhaust outlet port 37A. A fin 58A is formed on a lower edge of reed valve 48A, as shown in FIG. 4. Fin 58A is adapted to project below the surface of the water when the watercraft is in operation. The flow of water during operation of the boat exerts a dynamic pressure on fin 58A which tends to cause reed valve 48A to open exhaust outlet port 37A. As shown in FIG. 3, reed valve 48A is normally positioned to close exhaust outlet port 37A, but when the water craft is running, the water hitting fin 58A and the rise in exhaust pressure within second exhaust passage 36A exerts dynamic pressure forces on reed valve 48A to cause reed valve 48A to shift to an open position as shown by the broken lines in FIG. 3. In this position, reed valve 48A permits exhaust gases to be emitted through exhaust outlet 37A.

As shown in these figures, stopper plate 46A extends across exhaust outlet port 37A a distance less than reed valve 48A and is spaced rearwardly from reed valve 48A when reed valve 48A is in a closed position. Stopper plate 46A functions to limit the deflection of reed valve 48A when reed valve 48A reaches a fully open position. Reference numeral 60 in FIG. 3 refers to a partition inside cavitation cavity 23 which separates second exhaust passage 36 into exhaust passages 36A and 36B.

The operation of the exhaust arrangement of the present invention will now be described. When the watercraft is stopped, running at a low speed, decelerating or immediately after planning, cavitation plate 22 is exposed above the surface of the water. At this time, the exhaust gas pressure is low and the dynamic water pressure on the fins 58A, 58B is also low. Therefore, reed valves 48A, 48B are fully or near fully closed so as to close exhaust outlet ports 37A and 37B of second exhaust passage 36. By closing second exhaust passage 36 during these operational modes of the watercraft, exhaust noise can be greatly reduced. If the watercraft is accelerated to a mid or high speed level, the exhaust gas pressure and the dynamic water pressure acting on fins 58A and 58B cause reed valves 48A and 48B to shift in the direction of arrow 62 in FIG. 3 to an open position. Since the reed valves 48A and 48B are secured to respective lateral sidewalls of exhaust outlet ports 37A and 37B, both reed valves 48A and 48B can be fully opened to a position such that no water surface blocks exhaust outlet ports 37A and 37B. As a result, exhaust gases can be expelled directly into the atmosphere without being blocked by the surface of the water as is associated with the prior art. This results in preventing the build up of exhaust gas back pressure and improves the operating performance of propulsion unit 1.

Although described with respect to a preferred embodiment of the invention, it should be readily understood that various changes and/or modifications can be made to the present invention without departing from the spirit of the invention. For instance, in the preferred embodiment described above, fins 58A and 58B are stated to be mounted at the lower end of reed valves 48A and 48B respectively so that the dynamic pressure of the water flow is employed to open the valves. This allows the speed of the watercraft to be used to control the area of the exhaust outlet opening. The degree to which the reed valves open can be controlled by adjusting the thickness or mechanical strength of the reed valve. Of course, it can also be possible to eliminate the fins on the reed valves entirely and allow the reed valves to be opened only by the force of the exhaust gas pressure. In addition, although reed valves are used in the preferred embodiment of the invention, it should be readily understood that various other flapper valve arrangements could be used such as valves made of rubber, other synthetic materials or other metals, including spring biased hinge-type valve members. It is only important within the scope of the present invention to elastically support the valves on their sides in a normally closed position. Finally, although the preferred embodiment features a pair of exhaust valves and support structure therefor, it should be readily apparent that it is possible to eliminate the use of partition 60 thereby having just one second or supplemental exhaust passage having a single associated valve. In general, the invention is only intended to limited by the scope of the following claims.

I claim:

1. In a marine propulsion unit adapted to be secured to and project rearwardly from a transom of a watercraft and having an exhaust assembly including a rearwardly extending exhaust passage formed within a casing above a propeller of the propulsion unit and terminating in an exhaust outlet port defined by upper, lower and lateral sidewalls, the improvement wherein said exhaust assembly comprises a normally closed flapper valve member having a fixed portion secured to one of said lateral sidewalls and a cantilevered portion extending across said exhaust outlet port with said cantilevered portion being adapted to elastically flex relative to said fixed portion so as to open and close said exhaust outlet port in response to dynamic forces acting on said valve member during operation of the watercraft and means for limiting the degree to which said cantilevered portion can flex relative to said fixed portion of said valve member, said limiting means comprising a stopper member secured to said casing through a fastener means.

2. The improvement as claimed in claim 1, wherein said stopper member comprises a stopper plate having a first end portion fixedly secured to at least one of said upper, lower and lateral sidewalls and a second end portion extending at least partially across said exhaust outlet port, the second end portion of said stopper plate being spaced from said valve member when said valve member is positioned to close said exhaust outlet port and being engaged by said valve member, to limit the deflection of said valve member, when said valve member is positioned to fully open said exhaust outlet port.

3. The improvement as claimed in claim 2, wherein said fastener means fixedly secures both the fixed portion of said valve member and the first end portion of said stopper plate to said one lateral sidewall.

4. The improvement as claimed in claim 1, wherein said cantilevered portion of said valve member includes a fin secured thereto, said fin projecting from said cantilevered portion toward said propeller.

5. The improvement as claimed in claim 1, further including a partition for dividing said exhaust passage so as to define plural exhaust outlet ports each of which is provided with and adapted to be opened and closed by a respective said flapper valve member.

* * * * *